US005578773A

United States Patent [19]

Wisell

[11] Patent Number: 5,578,773

[45] Date of Patent: Nov. 26, 1996

[54] HIGH-SPEED STEEL MANUFACTURED BY POWDER METALLURGY

[75] Inventor: Henry Wisell, Söderfors, Sweden

[73] Assignee: Erasteel Kloster Aktiebolag, Soderfors, Sweden

[21] Appl. No.: 193,045

[22] PCT Filed: Aug. 4, 1992

[86] PCT No.: PCT/SE92/00538

§ 371 Date: Feb. 4, 1994

§ 102(e) Date: Feb. 4, 1994

[87] PCT Pub. No.: WO93/02821

PCT Pub. Date: Feb. 18, 1993

[30] Foreign Application Priority Data

Aug. 7, 1991 [SE] Sweden ..... 9102299
Dec. 11, 1991 [SE] Sweden ..... 9103650

[51] Int. Cl.[6] ..... C22C 35/00

[52] U.S. Cl. ..... 75/246; 75/243; 75/239

[58] Field of Search ..... 75/246, 243, 239

[56] References Cited

U.S. PATENT DOCUMENTS

| | | | |
|---|---|---|---|
| 4,519,839 | 5/1985 | Toyoaki et al. | 75/242 |
| 4,780,139 | 10/1988 | Hellman et al. | 75/240 |
| 4,880,461 | 11/1989 | Uchida | 75/238 |
| 4,936,911 | 6/1990 | Roberts et al. | 75/238 |
| 4,964,908 | 10/1990 | Greetham | 75/241 |

FOREIGN PATENT DOCUMENTS

| | | | |
|---|---|---|---|
| 0377307 | 7/1990 | European Pat. Off. | C22C 33/02 |
| 0467857 | 1/1992 | European Pat. Off. | C22C 33/02 |
| 63-118054 | 5/1988 | Japan . | |
| 1-139741 | 6/1989 | Japan . | |
| 1-152242 | 6/1989 | Japan . | |
| 1-309737 | 12/1989 | Japan . | |
| 2-109619 | 4/1990 | Japan . | |
| 2-194144 | 7/1990 | Japan . | |
| 3-138336 | 6/1991 | Japan . | |
| 3285040 | 12/1991 | Japan . | |

*Primary Examiner*—Ngoclan Mai
*Attorney, Agent, or Firm*—Michael D. Bednarek; Kilpatrick & Cody

[57] ABSTRACT

The invention relates to a high-speed steel which is manufactured powder-metallurgically and has the following chemical composition: 2.2–2.7 C, from traces to max 1.0 Si, from traces to max 1.0 Mn, 3.5–4.5 Cr, 2.5–4.5 Mo, 2.5–4.5 W, 7.5–9.5 V, with the balance being substantially iron and incidental impurities and accessory elements. The steel is suitable particularly for tools having a high wear resistance.

7 Claims, 3 Drawing Sheets

HIGH-SPEED STEEL MANUFACTURED BY POWDER METALLURGY

BACKGROUND OF THE INVENTION

The present invention relates to a high-speed steel with a new alloy composition. The steel is designed in the first place for the manufacture of tools having a high wear resistance. Particularly, the steel is intended for tools for cutting wood and paper, such as paper sheet cutting knives; powder dies and drifts, etc. Other conceivable applications are for wear parts, such as for details which are exposed to wear against roadways, for example tire studs and for other applications where the wear resistance is of primary importance, while the demands as far as toughness are concerned are more moderate.

For these applications there is today used a high-speed steel which is marketed under the trade name ASP® 23 (currently available from Erasteel Kloster Aktiebolag, a Swedish corporation), which has the nominal composition 1.29 C, 0.4 Si, 0.3 Mn, 4.0 Cr, 5.0 Mo, 6.2 W, 3.1 V, balance iron and impurities in normal amounts. Characteristic features of this steel are that it has a comparatively good wear resistance and a comparatively good toughness. However, there is a demand for tools having a still better wear resistance, whereas a certain reduction of the toughness can be tolerated. This particularly concerns objects of the type which are mentioned in the preamble. A steel which has a very high wear resistance is the steel which is marketed under the trade name ASP® 60 (currently available from Erasteel Kloster Speedsteel Aktiebolag, a Swedish corporation) and which has the nominal composition 2.30 C, 4.2 Cr, 7.0 Mo, 6.5 W, 10.5 Co, 6.5 V, balance iron and impurities in normal amounts. This steel is used for metal cutting tools and for cold work tools but is not suitable for the type of tools which are mentioned in the preamble; i.e., for tools intended for cutting paper and wood, etc. This type of tools often require a shape which is difficult to produce because the steel is difficult to machine, which in its turn depends on the limited toughness of the steel.

*ASP is a registered trade mark of Kloster Speedsteel Aktiebolag.

It is an object of the invention to provide a new high-speed steel which, better than steels used in the past satisfies the various requirements which are raised on steels for tools of the type mentioned in the preamble, and which requirements are difficult to combine.

Particularly, the invention aims at providing a high-speed steel having a wear resistance which is substantially better than that of the commercially available steel ASP® 23, and preferably as good or better than that of the commercially available steel ASP® 60 in combination with a very good toughness, which means that the toughness shall be substantially better than that of the commercially available steel ASP® 60 and preferably in the same order as that of the commercially available steel ASP® 23.

These and other objects may be achieved therein that the steel is characterized by what is stated in the appending claims.

In the following, the choice of the various alloy elements will be explained more in detail. Herein some theories will be made concerning the mechanisms which are considered to be the basis for the achieved effects. It should, however, be understood that the claimed patent protection is not bound to any particular theory.

DESCRIPTION OF THE INVENTION

Carbon is multifunctional in the steel of the invention. It forms MC-carbides, in the first place with vanadium, which carbides exist as undissolved primary carbides and as precipitation hardening secondary carbides. Further, carbon forms precipitation hardening $M_2C$-carbides in the first place with molybdenum and tungsten. The carbon content therefore in the first place is adapted to the contents of vanadium, molybdenum and tungsten for the formation of the said carbides, which also contain minor amounts of chromium, iron and manganese.

Therefore, the carbon content shall be at least 2.2%, preferably at least 2.25%, suitably at least 2.3%. On the other hand, the carbon content must not be so high that it will cause embitterment. These conditions allow only a narrow, optimal carbon content range and imply that the carbon content must not be more than 2.7%, preferably max 2.6% and suitably max 2.55%. An optimal carbon content may be 2.4 or 2.5%.

Silicon may exist in the steel as a residue from the deoxidation of the steel melts in amounts which are normal from the melt metallurgical deoxidation practice, i.e. max 1.0%, normally max 0.7%.

Manganese may also exist in the first place as a residue from the melt-metallurgical process-technique, where manganese has importance in order to make sulphur impurities harmless, in a manner known per se, through the formation of manganese sulfides. The maximal content of manganese in the steel is 1.0%, preferably max 0.5%.

Chromium shall exist in the steel in an amount of at least 3%, preferably at least 3.5%, in order to contribute to a sufficient hardness of the matrix of the steel. Too much chromium, however, will cause a risk for retained austenite which may be difficult to transform. The chromium content therefore is limited to max 5%, preferably to max 4.5%.

Molybdenum and tungsten shall exist in the steel in order to bring about a secondary hardening effect during tempering after solution heat treatment because of the precipitation of $M_2C$-carbides, which contribute to the desired wear resistance of the steel. The ranges are adapted to the other alloying elements in order to bring about a proper secondary hardening effect. Molybdenum should exist in an amount of at least 2.5%, preferably at least 2.7%, and suitably at least 2.8%. Tungsten should also exist in an amount of at least 2.5% but preferably in an amount not less than 3.7%, and suitably at least 3.8%. The molybdenum content should not exceed 4.5%, preferably not exceed 3.3%, and suitably not exceed 3.2%, while the tungsten content should not exceed 4.5%, preferably not exceed 4.3% and suitably not exceed 4.2%. In principle, molybdenum and tungsten wholly or partly may replace each other, which means that tungsten may be replaced by half the amount of molybdenum, or molybdenum be replaced by the double amount of tungsten. One knows, however, from experience that molybdenum and tungsten should exist in the said proportions on this total level of the said alloying elements since this gives some production technical advantages, more particularly advantages relating to the heat treatment technique.

Vanadium and carbon form very hard vanadium carbides, MC. The more vanadium the steel contains, the more MC-carbides are formed (provided that a corresponding amount of carbon is supplied) and the more wear resistant will be the steel. The vanadium content therefore shall be high. High-speed steels having high contents of vanadium, as well as high-speed steels having vanadium contents which are normal for conventional high-speed steels will, however, be brittle, if the material is manufactured through conventional ingot manufacture, because in this case there will be produced large and generally unevenly distributed primary carbides, which are not dissolved during the hardening operation but will remain undissolved and cause brittleness.

This problem according to the invention is solved by manufacturing the steel powder-metallurgically, wherein there is ensured that the primary vanadium carbides will be small and evenly distributed in the steel.

The minor part of vanadium carbide volume which is dissolved during the hardening, however, is re-precipitated as MC-carbides at the tempering operation, which contribute to an augmentation of the secondary hardening.

Vanadium thus has a key role for the establishment of the high wear resistance of the steel—and also for the provision of an adequate toughness according to the invention—and shall therefore exist in an amount of at least 7.5%, preferably at least 7.8%, and suitably at least 7.9%. Too much vanadium, however, may cause brittleness, and therefore the vanadium content is limited to max 9.5%, preferably max 9%, and suitably max 8.5%. The nominal vanadium content is 8%.

Besides the above mentioned elements, the steel also contains nitrogen, unavoidable impurities and other residuals from the melt-metallurgical treatment of the steel than the above mentioned in normal amounts. Cobalt, which may exist in certain high-speed steels and other tool steels, normally does not exist in this steel but can be tolerated in amounts up to max 1.0%, preferably max 0.5%. As the steel shall be useful at room temperature, however, the steel suitably does not contain any cobalt, since this element reduces the toughness of the steel. Other elements may intentionally be added to the steel in minor amounts, providing they do not have any unfavorable impact upon the intended interactions between the alloy elements of the steel, and also providing they do not impair the desired features of the steel as well as its suitability for the intended applications.

The technical features of the steel can be described according to the following:

The steel is a powder-metallurgically manufactured high-speed steel, the alloy composition of which in the first place is characterized by a high content of vanadium. In the delivery condition the steel has a substantially ferritic matrix, which contains a significant volume of carbide, in the first place vanadium carbide. The carbides are fine-grained and evenly distributed in the steel.

After solution heat treatment in the temperature range 1000°–1250° C., preferably in the range 1050°–1220° C., and cooling to room temperature, the matrix of the steel has a predominantly martensitic structure but containing a high content of retained austenite. The carbides are partly dissolved, but 15–20 volume-% of fine-grained, evenly distributed vanadium carbides remain in the steel.

By tempering to a temperature within the temperature range 500°–600° C., the hardness is increased to 58–66 HRC (the hardness within this range depends on the solution heat treatment temperature) due to the fact that the retained austenite essentially is eliminated and transformed to martensite and through secondary precipitation on one hand of $M_2C$-carbides where M mainly consists of molybdenum and tungsten and to a minor part of chromium, manganese and iron, and on the other hand of MC-carbides, where M mainly consists of vanadium.

Due to the large amount of vanadium carbide, the hardened and tempered steel obtains a very high wear resistance at room temperature, and through the alloy combination the steel in other respects achieve a combination of hardness and toughness which is adequate for, for example, the following types of tools: tools for cutting paper and wood, such as paper sheet cutting knives; powder dies and drifts. Other conceivable uses are for objects which are exposed to wear against roadways, such as tire studs.

BRIEF DESCRIPTION OF THE DRAWINGS

The steel of the invention and its features will be explained more in detail in the following description with reference to performed experiments. Herein reference will be made to the accompanying drawings, in which.

The investigated steels had a composition according to Table 1, in which steels Nos. 9 and 10 are reference materials (nominal composition).

TABLE 1

Figure 1:
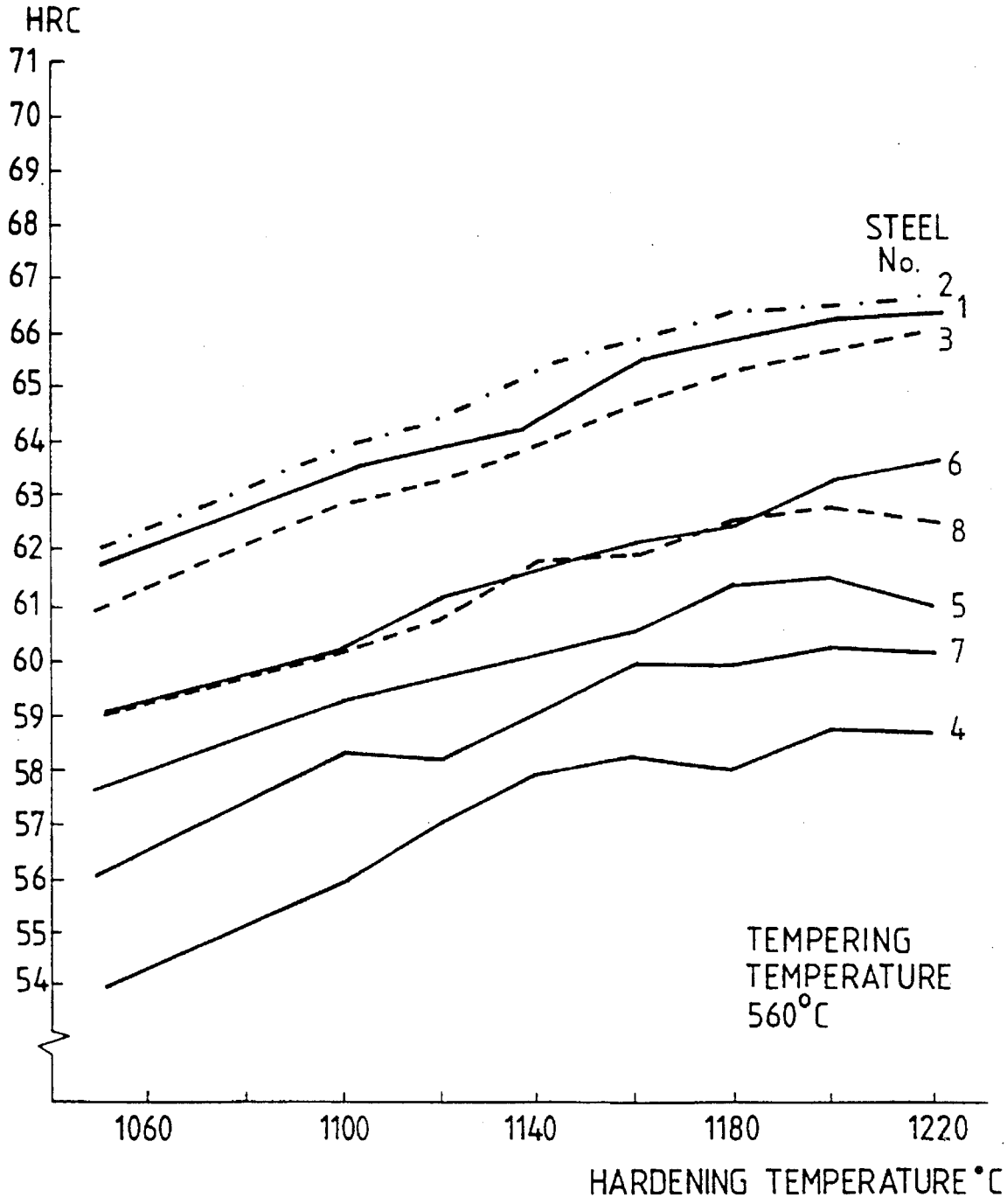
FIG. 1 is a diagram containing curves which show the hardness of the investigated steels after tempering versus the hardening temperature.
Figure 2:
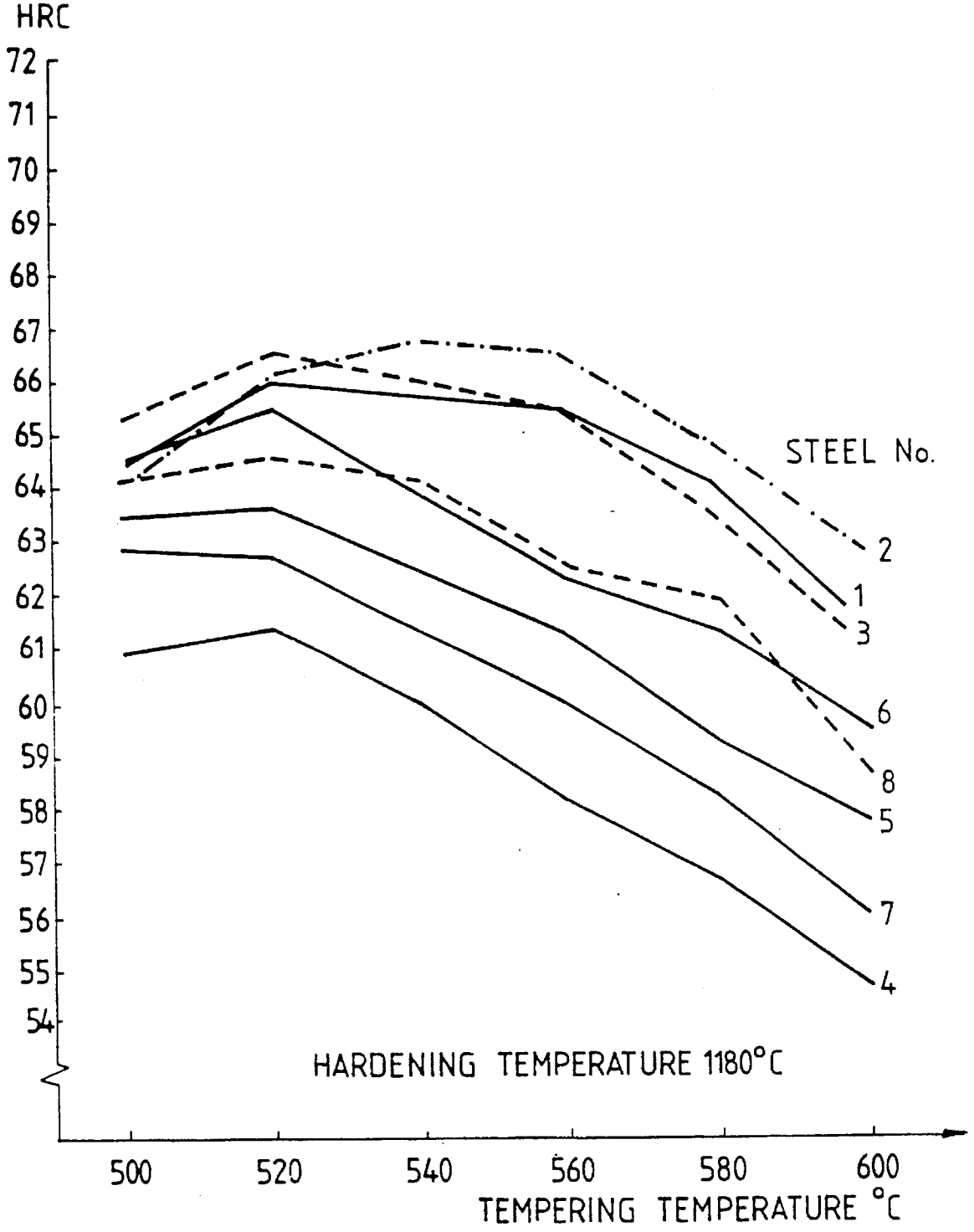
FIG. 2 is a graph containing curves showing the hardness of the investigated steels versus the tempering temperature.

| Steel No | Charge No or steel grade | C | Si | Mn | Cr | Ni | Mo | W | Co | V | N |
|---|---|---|---|---|---|---|---|---|---|---|---|
| 1 | 911401 | 2.50 | .54 | .28 | 4.01 | .096 | 2.92 | 2.97 | .53 | 8.19 | .065 |
| 2 | 911402 | 2.65 | .49 | .30 | 3.97 | .19 | 2.96 | 3.97 | .52 | 8.11 | .083 |
| 3 | 911400 | 2.38 | .49 | .28 | 4.18 | .37 | 2.94 | 3.89 | .51 | 8.14 | .102 |
| 4 | 911284 | 1.94 | .51 | .34 | 4.0 | n.a. | 3.1 | 4.1 | .30 | 8.5 | n.a. |
| 5 | 911285 | 2.11 | .53 | .38 | 4.0 | n.a. | 3.0 | 4.1 | .23 | 8.55 | n.a. |
| 6 | 911286 | 2.26 | .48 | .34 | 4.0 | n.a. | 2.87 | 3.9 | .22 | 8.4 | n.a. |
| 7 | 911287 | 2.53 | .47 | .30 | 4.1 | n.a. | 2.85 | 4.3 | .20 | 10.5 | n.a. |
| 8 | 911288 | 2.64 | .46 | .27 | 4.1 | n.a. | 2.9 | 4.2 | .14 | 10.3 | n.a. |
| 9 | ASP ®23 | 1.29 | .4 | .3 | 4.0 | | 5.0 | 6.2 | | 3.1 | |
| 10 | ASP ®60 | 2.30 | .4 | .3 | 4.2 | | 7.0 | 6.5 | 10.5 | 6.5 | |

n.a. = not analyzed but are considered to lie on a normal impurity content level All the steels were manufactured powder-metallurgically in the form of 200 kg capsules, which were compacted to full density through hot isostatic pressing at 1150° C., 1 h and 1000 bar. From this material there were made rods with the dimension 10 mm Ø through hot rolling. From these rods there were made test specimens which were hardened through solution heat treatment at hardening temperatures varying between 1050° and 1220° C., cooling to room temperature and tempering to different temperatures between 500° and 600° C. Hardnesses achieved from different hardening temperatures after tempering at 560° C. are shown through the curves in FIG. 1, whereas the depency of the hardness of the tempering temperature are shown by the curves in FIG. 2. In the latter case, all the steels were hardened from a solution temperature of 1180° C. From the graphs it can be seen that the highest hardness is achieved by steels Nos. 1, 2 and 3 of the invention. Paper sheet cutting knives were made from a steel having a composition according to the invention. Theses knives had an effective lifetime of about 3 months when subjected to field test, whereas knives made of the commercially available steel reference material ASP® 23 had a lifetime of about 3 weeks under similar conditions, which indicates that the steel of the invention has a very good wear resistance when it is used for cutting paper and that it also has a sufficient toughness for this application.

During continued tests steel No. 1 of the invention (see Table 1) was compared with the commercial available steels ASP® 23 (steel No. 9) and ASP® 60 (steel No. 10) with reference to wear resistance and toughness. The wear resistance measurements were performed through so-called "pin-on-reciprocating-plate" measurement. The material, mg, was measured, which was worn off during a period of time of 2 h from a tool made of the steel in question, which was pressed against an alumina plate moving at a rate of 0.2 m/s. The toughness was measured in a 4-point-bend test. Cylindrical test specimens were bent until rupture. The deflection at rupture was measured, which is s measurement of the toughness. The measured values are shown in Table 2. In this table also the wear resistance indexes for the examined steels have been inserted. The wear resistance index is the inverted value of the wear expressed in grams.

TABLE 2

| Steel No. | Wear mg | Wear resistance index 1/g | Toughness (deflection at rupture) mm |
|---|---|---|---|
| 1 | 405 | 2.5 | 1.93 |
| 9 | 880 | 1.1 | 2.20 |
| 10 | 461 | 2.2 | 1.00 |

Figure 3:
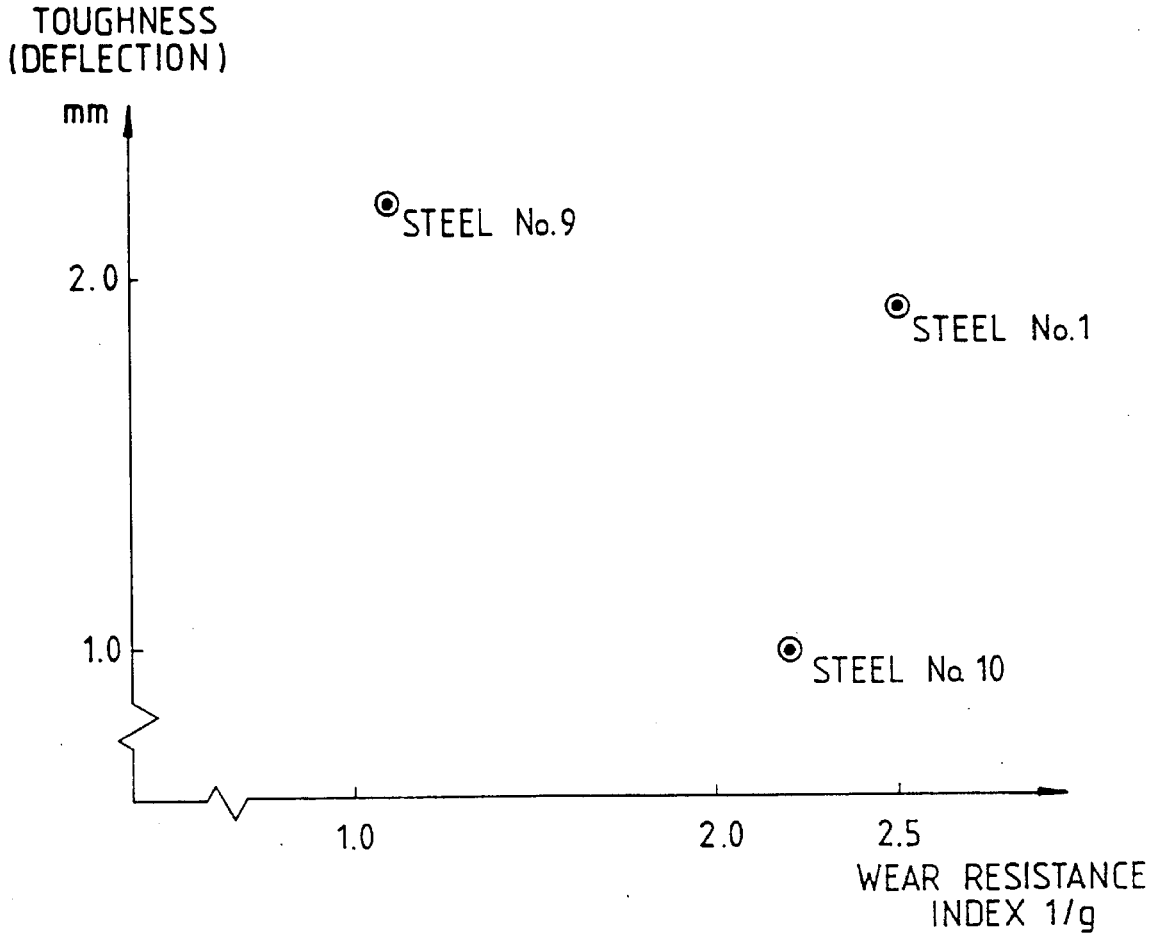
FIG. 3 is a graph showing the toughness and wear resistance of a steel according to the invention and of two commercial high-speed steels.

The values in Table 2 are also shown graphically in FIG. 3, which clearly shows that steel No. 1 of the invention in combination possesses the good features of the commercially grades available ASP® 23 (steel No. 9) and ASP® 60 (steel No. 10), namely good toughness and high wear resistance.

I claim:

1. High-speed steel manufactured powder-metallurgically and comprising the following chemical composition in weight-%:

2.2–2.7 C from traces to max 1.0 Si from traces to max 1.0 Mn 3.5–4.5 Cr
2.5–4.5 Mo
2.5–4.5 W
7.5–9.5 V from traces to max 1.0 Co with the balance being substantially iron and incidental impurities and accessory elements.

2. High-speed steel according to claim 1, comprising the following chemical composition in weight-%:

2.25–2.60 C from traces to max 1.0 Si from traces to max 1.0 Mn 3.7–4.3 Cr
2.7–3.3 Mo
3.7–4.3 W
7.8–9 V from traces to max 1.0 Co with the balance being substantially iron and incidental impurities and accessory elements.

3. High-speed steel according to claim 1, comprising the following chemical composition in weight-%:

2.3–2.55 C
max 0.7 Si
max 0.5 Mn
3.8–4.2 Cr
2.8–3.2 Mo
3.8–4.2 W
7.9–8.5 V from traces to max 1.0 Co with the balance being substantially iron and incidental impurities and accessory elements.

4. High-speed steel according to claim 1, comprising the following chemical composition in weight-%:

2.5 C
0.4 Si
0.3 Mn
4 Cr
3 Mo
4 W
8 V from traces to max 1.0 Co with the balance being substantially iron and incidental impurities and accessory elements.

5. High-speed steel according to claim 1, comprising the following chemical composition in weight-%:

2.4 C
0.4 Si
0.3 Mn
4 Cr
3 Mo
4 W
8 V from traces to max 1.0 Co with the balance being substantially iron and incidental impurities and accessory elements.

6. High-speed steel according to claim 1, wherein said steel has a hardness of 58–66 HRC and contains 10–20 volume-% MC-carbides after being hardened from a temperature between 1000° and 1250° C., cooled to room temperature, and tempered at 500°–600° C.

7. A body of high-speed steel having an alloy composition according to claim 1, said body being made from a powder of said steel, which is consolidated to full density, said steel of said body having a hardness of 58–66 HRC and a structure containing 10–20 volume-% MC-carbides, mainly in the form of V-carbides, said hardness and structure being obtained by hardening the steel body from a temperature between 1000° and 1250° C., cooling to room temperature and tempering at 500°–600° C.

* * * * *